US010954023B2

(12) United States Patent
Winberg et al.

(10) Patent No.: US 10,954,023 B2
(45) Date of Patent: Mar. 23, 2021

(54) PACKAGE FOR POURABLE FOOD PRODUCTS AND METHOD FOR MOULDING A POLYMERIC OPENING PORTION

(71) Applicant: Tetra Laval Holdings & Finance S.A., Pully (CH)

(72) Inventors: Petra Winberg, Rydebäck (SE); Mats Qvarford, Lund (SE); Niels Damkjaer, Kävlinge (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 16/472,401

(22) PCT Filed: Dec. 19, 2017

(86) PCT No.: PCT/EP2017/083628
§ 371 (c)(1),
(2) Date: Jun. 21, 2019

(87) PCT Pub. No.: WO2018/122052
PCT Pub. Date: Jul. 5, 2018

(65) Prior Publication Data

US 2019/0359370 A1 Nov. 28, 2019

(30) Foreign Application Priority Data

Dec. 29, 2016 (EP) ..... 16207250

(51) Int. Cl.
*B65D 5/06* (2006.01)
*B65D 8/00* (2006.01)
(Continued)

(52) U.S. Cl.
CPC ..... *B65D 5/065* (2013.01); *B65D 15/08* (2013.01); *B65D 5/746* (2013.01);
(Continued)

(58) Field of Classification Search
CPC .... B65D 5/065; B65D 15/08; B65D 41/0407; B65D 5/746; B65D 47/103; B65D 51/20;
(Continued)

(56) References Cited

U.S. PATENT DOCUMENTS 4,669,640 A * 6/1987 Ando ..... B65D 5/746 156/69
5,065,938 A * 11/1991 Anderson ..... B65D 5/746 229/125.08
(Continued)

FOREIGN PATENT DOCUMENTS

CN 1777406 5/2006
EP 0167095 A2 1/1986
(Continued)

OTHER PUBLICATIONS

Search Report and Written Opinion in International Application No. PCT/EP2017/083628, dated Feb. 1, 2018, in 12 pages.

*Primary Examiner* — Christopher R Demeree
(74) *Attorney, Agent, or Firm* — Knobbe, Martens, Olson & Bear, LLP

(57) ABSTRACT

A package for pourable food products and method for moulding a polymeric opening portion to a packaging sheet material is provided. The package can include an opening portion and a weakening feature. In some embodiments, the opening portion can be made of a polymer composition. In some embodiments, the weakening feature has a thickness below 200 micrometers and is thinner than parts of the opening portion directly adjacent to said weakening feature. The polymer composition can include sodium sulphite particles. In some embodiments, the sodium sulphite particles have the following size characteristics: (i) 0% having a size above 75 micrometers, and (ii) an average size below 25 micrometers.

14 Claims, 5 Drawing Sheets

(51) Int. Cl.
*B65D 5/74* (2006.01)
*B65D 41/04* (2006.01)
*B65D 51/24* (2006.01)
*B65D 81/26* (2006.01)

(52) U.S. Cl.
CPC ..... *B65D 41/0407* (2013.01); *B65D 51/244* (2013.01); *B65D 81/266* (2013.01)

(58) Field of Classification Search
CPC ..... B65D 5/749; B29C 66/53247; B29L 2031/7166; B31B 50/84
USPC .... 229/216, 125.15, 125.14, 125.04, 125.05, 229/125.42; 222/541.5, 562; 220/258.2, 220/258.3, 258.4, 276, 265; 156/69; 215/250, 256; 426/115
See application file for complete search history.

(56) References Cited

U.S. PATENT DOCUMENTS 5,101,999 A * 4/1992 Robichaud ..... B65D 5/748 220/258.4
5,110,041 A * 5/1992 Keeler ..... B29C 65/02 220/265
5,133,486 A * 7/1992 Moore ..... B65D 5/746 220/258.2
5,735,426 A * 4/1998 Babcock ..... B65D 5/746 215/256
5,765,747 A * 6/1998 Lawson ..... B65D 5/746 222/541.9
5,934,496 A * 8/1999 Mogard ..... B65B 7/2878 220/258.3
6,179,147 B1 1/2001 Mogard et al.
8,066,141 B2 * 11/2011 Casale ..... B65D 5/749 215/232
8,113,374 B2 * 2/2012 Steiger ..... B65D 51/20 220/258.4
2013/0216671 A1 8/2013 Raw et al.

FOREIGN PATENT DOCUMENTS

EP 0836935 A2 4/1998
JP 2000-281142 A 10/2000
JP 2007-015708 A 1/2007
RU 2552554 C2 6/2015
WO WO 03/025048 A1 3/2003
WO WO 2011/073104 A1 6/2011

* cited by examiner

PACKAGE FOR POURABLE FOOD PRODUCTS AND METHOD FOR MOULDING A POLYMERIC OPENING PORTION

TECHNICAL FIELD

Present invention relates to a package for pourable food products in general and a package for pourable food products with an opening portion from a polymer composition comprising sodium sulphite particles and a weakening feature in particular.

Present invention further relates to a package for pourable food products with an opening portion comprising sodium sulphite particles and a package container body.

BACKGROUND

Opening arrangements of different types provided on a packaging container, such as containers formed by packaging sheet material and adapted for containing substances such as foodstuffs, and in particular for containing liquid beverages such as juices, water, milk, wine, etc. are known.

One such opening arrangement includes a hole or attenuation on a wall part of the packaging container and a plastics material opening device attached to the wall part and covering the hole in a closed state. The opening device includes a circumferential base attached to the wall part, for example the lid part of the opening device may be attached to the base for example by a plastic hinge. When the lid element is opened, the hole may be engaged and forced open such that the contents inside the packaging container may be dispensed therefrom.

An aluminium foil, is commonly used as a barrier against oxygen within the field of packaged foods. By having a barrier against oxygen, oxidative degradation can be reduced, leading to higher food quality as well as extended shelf-life for the food product.

However, when moulding an opening onto a package for pourable foods tear-lines are in many cases required for easy opening of a moulded part, but keeping the package sealed until consumption. Such tear-lines are not protected by a barrier material against oxygen permeation and have thinner thickness than the surrounding package material and are therefore more susceptible to oxygen penetration. Thus, the relatively unprotected state of the tear-lines may cause several issues.

Usage of sodium and potassium sulphite particles as "oxygen eaters" in packaging materials is known for a person skilled in the art. However, the previously used oxygen eaters are not suitable for an opening portion with a tear line and is associated with drawbacks which will be further discussed in the detailed description.

Similar issues may arise with regards to an interface between an opening portion and a package container body.

Hence, there is a need to provide a package for pourable food which addresses the disadvantages and shortcomings of the prior art in general and to provide a package for pourable food which allows for a reduced oxygen permeability.

SUMMARY

Accordingly, the present invention preferably seeks to mitigate, alleviate or eliminate one or more of the above-identified deficiencies in the art and disadvantages singly or in any combination and solves at least the above mentioned problems by providing a package for pourable food products; the package comprising an opening portion; the opening portion being formed from a polymer composition and comprising a weakening feature having a thickness below 200 micrometers and being thinner than parts of the opening portion directly adjacent to said weakening feature; the polymer composition comprising sodium sulphite particles, the particles having the following size characteristics: (i) 0% having a size above 75 micrometers, and (ii) an average size below 25 micrometers.

The sodium sulphite particles reduce the oxygen penetration to the packaged product through the weakening feature. Contrary to other oxygen-eaters known in the prior art, the particles provide adequate mechanical properties and less degradation of the packaging material due to less significant expansion of said particles as a result of water solubility, which reduces the inducing of cracks causing leakages.

The size of the particles is especially crucial with regards to a package with a weakening feature, such as a tear line or an attenuation in the material. Compared to alternative oxygen-eaters said sodium sulphite particles with the aforementioned size characteristics reduce the risk of accumulation of particles in the tear-line. Such accumulation of particles will eventually cause cracks during transportation and storage, due to the polymer composition being a two-phase and heterogeneous material, thus being more sensitive to load and tension in the material.

Even more preferably, the sodium sulphite particles may have the size characteristics: (i) 0% having a size above 50 micrometers, and (ii) an average size below 15 micrometers. Said size interval further reduces the oxygen penetration to the packaged food through the weakening feature.

Advantageously, the polymer composition of the polymeric opening portion comprises between 2-20 wt % sodium sulphite and even more preferably between 5-10 wt %.

According to one aspect of the invention a method for providing an opening portion for a package for pourable food products is presented. The method comprises adding sodium sulphite particles to a polymer composition adapted to form a polymeric opening portion of the package.

Advantageously, said particles have the following size characteristics:

(i) 0% having a size above 75 micrometers, and (ii) an average size below 25 micrometers;

The method further comprises forming the opening portion by moulding. Said opening portion comprises a weakening feature having a thickness below 200 micrometers and being thinner than parts of the opening portion directly adjacent to said weakening feature.

According to the aforementioned aspects of the invention, the weakening feature may be a weakened section such as for example a tear-line, a folding-line or a small penetration hole or other attenuation area.

According to another aspect of the invention a package for pourable food products is provided. The package comprises a package container body and an opening portion moulded onto said package container body thus forming an interface between said package container body and opening portion, the package container body comprising an oxygen barrier material, such as an aluminium foil.

Similar to the aforementioned aspects the opening portion formed from a polymer composition advantageously comprises sodium sulphite with the following size characteristics:

(i) 0% having a size above 75 micrometers, and (ii) an average size below 25 micrometers.

Since the oxygen barrier material may be insufficient or even non-present in the vicinity of or in the interface for example around a hole or perforation or a wall portion of the package, said interface will be susceptible for oxygen penetration. With the polymer composition comprising the specified particles the oxygen penetration can be significantly limited. In accordance with the previously described aspects of said invention the size characteristics of the sulphite particles provide less degradation or damage of the packaging material due to less significant expansion of said particles as a result of high water solubility. Thus, the risk for induced cracks causing an increase of oxygen gas penetration into the package, and/or leakages of packaged food product, may be significantly lowered.

Further advantages will be apparent from the detailed description as well as the appended dependent claims.

BRIEF DESCRIPTION OF DRAWINGS

These and other aspects, features and advantages of which the invention is capable, will be apparent and elucidated from the following description of embodiments of the present invention, reference being made to the accompanying drawings, in which.

DETAILED DESCRIPTION

Figure 1:
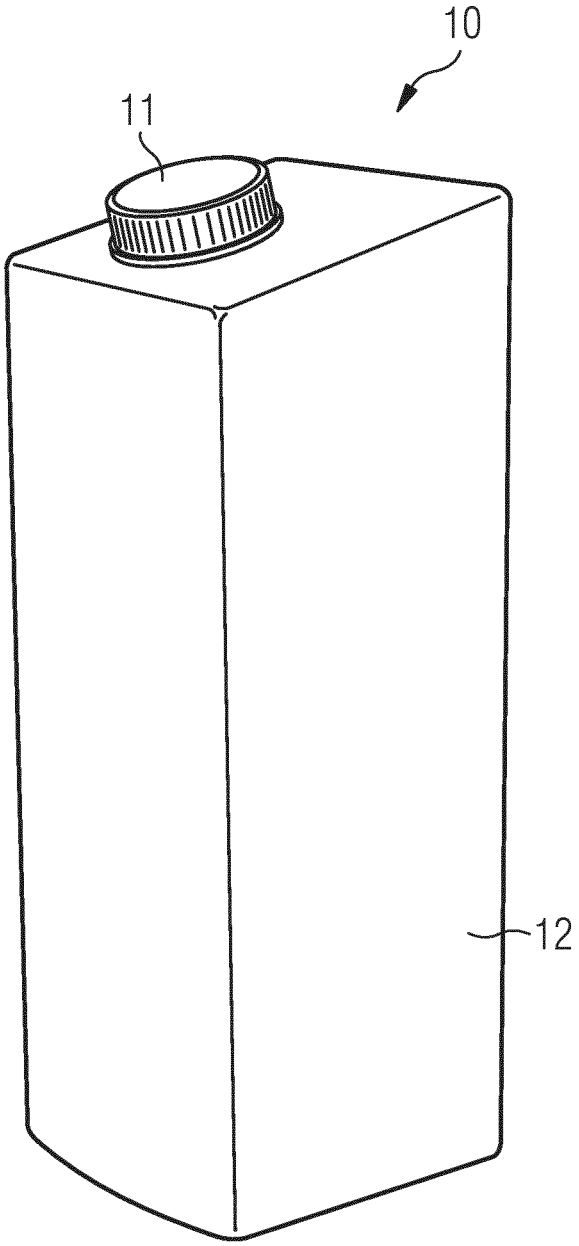
FIG. 1 is a side view of a package for pourable food according to one embodiment.

Returning to FIG. 1 a package 10 for pourable food is provided. The package 10 includes a polymeric opening portion 30 adapted to receive a cap 11. In FIG. 1 the package is depicted as a substantially rectangular paperboard based package further comprising aluminium foil in layered structure, however as the skilled person recognizes the package need not be limited to this material or shape.

Figure 2:
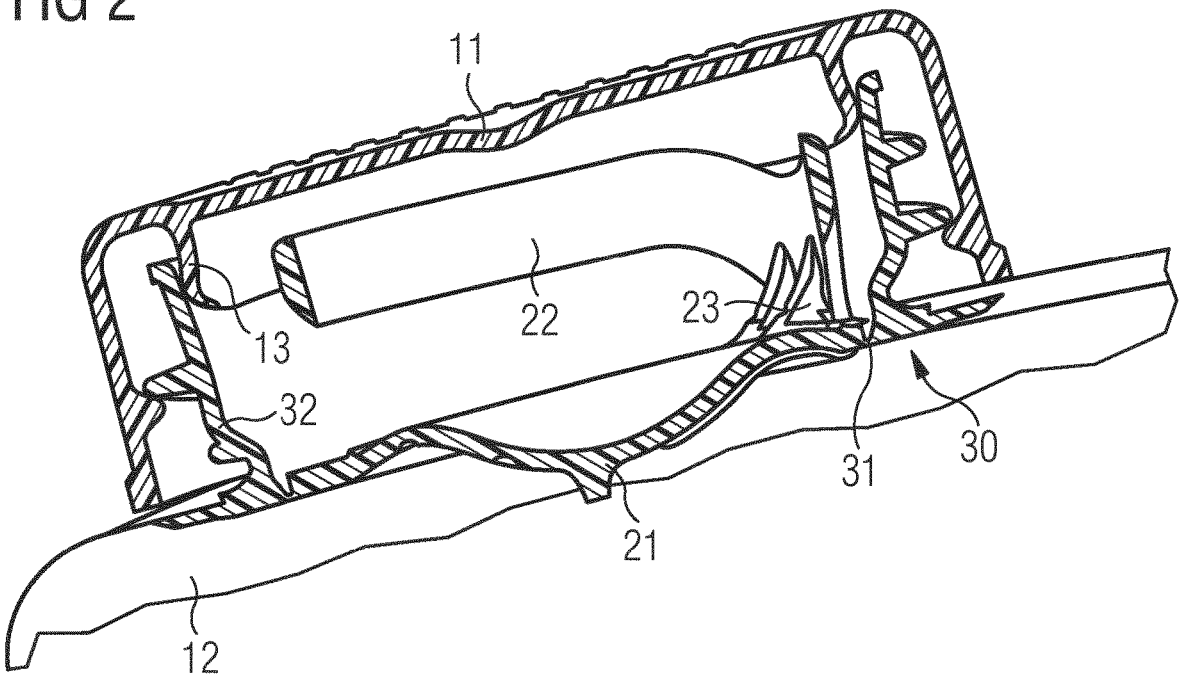
FIG. 2 is a cross section view of a polymeric opening portion according to one embodiment.
Figure 3:
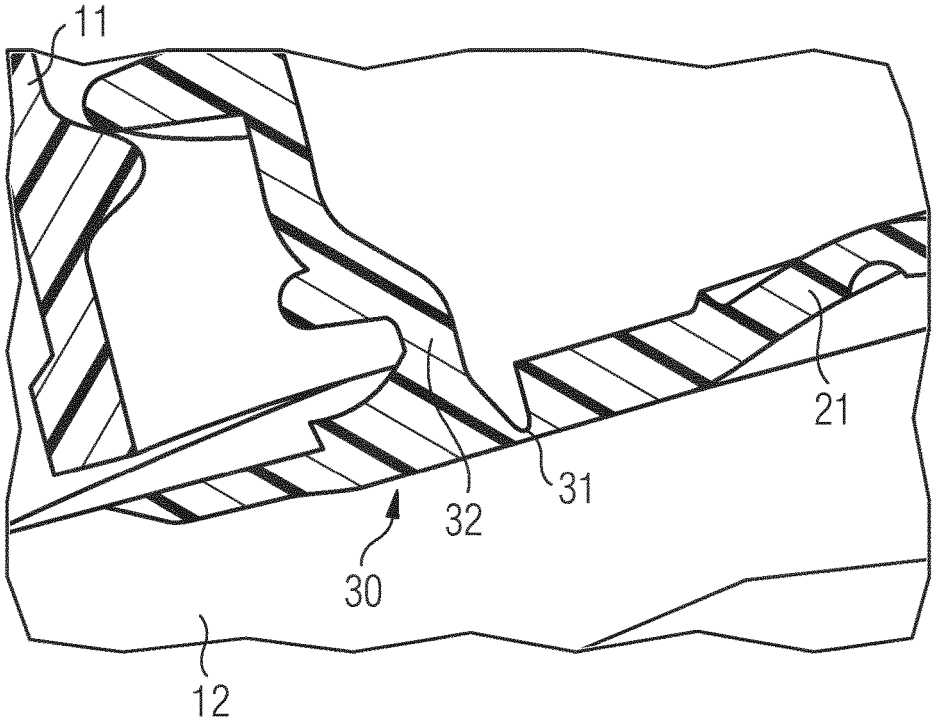
FIG. 3 is a cross section view of the area around a tear-line of a polymeric opening portion according to one embodiment.

Advantageously, as seen in FIGS. 2 and 3 the opening portion 30 include threaded element 32 adapted to receive the cap 11 in a sealing manner. To further ensure the sealing said threaded element 32 is further adapted to resiliently abut with an annular retaining element 13 of the cap 11.

Further referring to said FIGS. 2 and 3, the package 10 comprises a polymeric opening portion 30. The polymeric opening portion 30 may be manufactured from a polymer composition comprising any one of HDPE, LDPE, LLDPE or a blend of two or more thereof, i.e. a polymer blend comprising any of HDPE, LDPE and LLDPE.

To provide efficient sealing, the opening portion 30 is provided with a weakening feature with lesser dimensions or weaker mechanical properties and little or no oxygen barrier material enabling tearing or cutting open while providing sealing until consumption. Hence, said opening portion 30 may comprise a weaker section such as a tear-line at least partly surrounding, preferably completely surrounding, a sealing element 21 which is adapted to be torn and provide access to the packaged food for the consumer.

As shown in FIG. 2, the sealing element 21 further may comprise a strap 22 which allows for the consumer to tear off said sealing element 21.

With reference to said FIGS. 2 and 3, said opening portion 30 comprises a tear-line 31. The tear line 31 is thinner than parts of the opening portion 30 directly adjacent to said tear line 31. To ensure a successful tearing of the sealing element 21, the tear-line 31 may have a thickness below 200 micrometers.

The opening portion 30 may advantageously be moulded, for example via injection moulding or compression moulding. Thus, the opening portion can be moulded onto a package container 12. As is conventional, the package container body 12 may comprise an oxygen barrier material, such as aluminium foil, which functions as a barrier against oxygen intake and prevents degradation of the packaged food product.

Several conventional moulding processes are known in the arts and will not be described in detail in this application. However, for exemplary reasons an injection moulding process will be briefly described below.

Said package container 12 may be formed in a packaging machine for forming package containers from a driven web of packaging sheet material prior to moulding of the polymeric opening device 30 in an opening device moulding station. Said opening device moulding station is configured for moulding opening portions 30 on to the web at respective holes provided in the web. To provide the polymeric opening portion 30, the opening device moulding station includes first and second mould tools releasably arrangeable in closed positions, so as to form a mould cavity for accommodating the hole edge of the web. An injection passage for injecting heated thermoplastics material into the mould cavity extends in at least one of the first and second mould tools, such that the thermoplastics material is injected directly into the mould cavity at an injection point of the mould cavity which is located distally from the edge of the hole. Such mould forming of opening devices in a packaging machine, i.e. a filling and sealing machine forming packages filled with food product, takes place in a high-speed and high-accuracy packaging process, wherein opening portions are moulded onto the packaging material at the intended positions at high speed. Thus, the quality of the moulding tools and moulding compositions must be high and reliable, in order to produce packages and opening portions and opening devices of equally high quality. The speed of such packaging machines amount to several thousands of packages per hour, such as above ten thousand packages per hour.

In order to provide the sealing function of an opening device, the sealing element 21 may be moulded as an integral part of the polymeric opening portion 30 in conjunction with an induced weakening feature 31 in the moulded material around said sealing element 21, which may be for example a tear-line 31.

Accordingly, the opening portion 30 for the package 10 may be provided through a method comprising prior to the moulding adding sodium sulphite particles to a polymer composition adapted to form the opening portion 30 of the package 10. The particles have the aforementioned size characteristics, e.g. 0% of the particles having a size above 75 micrometers, as well as an average size below 25 micrometers.

The opening portion 30 is then formed by moulding, whereby said opening portion 30 comprises the weakening feature 31, such as for example a tear-line 31, having a thickness below 200 micrometers and being thinner than parts of the opening portion 30 directly adjacent to said weakening feature 31.

Said arrangement with a tearable sealing element 21 enables a longer shelf life due to the content of the package being sealed until consumption by the consumer. The arrangement with tear-lines is associated with issues particularly related to the sections of the opening portion with with lower oxygen barrier properties (due to the lower amount of oxygen scavenger and no oxygen barrier material being present), i.e. the tear-line 31 which enables the tearing of the sealing element 21.

One example of said issues arising with the usage of tear-lines is a reduced shelf-life of the packaged food product, due to increased oxygen permeability in the tear-line.

According to some embodiments the entire opening portion, constituting a relatively large portion of the packaging container, may comprise a thinner material which has a low amount of oxygen scavenger and no oxygen barrier material. An oxygen barrier material is stopping oxygen from migrating through the material, while an oxygen scavenger material absorbs or includes, i.e. "eats" the migrating oxygen until saturation of the material with oxygen.

Thus, oxygen-eaters may be used in order to decrease the oxygen degradation and oxygen permeability. Notably, this is accompanied with several challenges. Due to the thin dimension of the tear-line 31 it is especially susceptible to changes in dimensions which may damage the material around and in the tear-line 31 causing leakage and thus a reduced shelf-life.

Hence, the opening portion 30 may comprise sodium sulphite particles, such as for example anhydrous $Na_2SO_3$ particles. In comparison with other oxygen-eaters, such as for example potassium sulphite particles or organic polymeric scavengers, sodium sulphite particles have a lesser ability to absorb oxygen as well as moist. However, with the specific application in a thinner part, or weakening feature, such as a tear-line 31, the more conventional potassium sulphite particles and organic polymeric scavengers are unsuitable. The increased capability of the potassium sulphite particles to absorb moist as well as oxygen, leads to significant surface alteration and swelling of said particles, which has been found to lead to several undesirable effects.

Amongst other disadvantages, the increasing particle size due to swelling results in accumulation of potassium sulphite particles in the tear-line 31 which damages the material with a higher risk for penetration of oxygen gas, and/or for leakage of the packaged food product, as a result.

Furthermore, although sulphite salts other than sodium sulphite can be employed in said polymer opening portion 30 it is particularly favourable to use sodium sulphite as opposed to potassium sulphite as the water solubility of sodium salt is significantly lower water than the water solubility of potassium salt. The lower water solubility of sodium sulphite significantly reduces the tendency to agglomeration during the preparation of sodium sulphite master batches and compounds. Low degree of agglomeration is crucial to avoid sulphite particles getting stuck in the thinner parts of the packaging wall. Particles stuck in the thinner parts will eventually during transportation or storage cause a crack in the packaging wall and thereby loss of oxygen barrier properties of the filled package and/or loss of package integrity, i.e. tightness to avoid leakages of food product or penetration of microorganisms.

In support of the aforementioned, the solubility of water in potassium sulphite in the form of an anhydrous salt in a binary system increases with temperature however with a lower gradient than sodium sulphite. Still, the water solubility of sodium sulphite has been proven to be significantly lower than the potassium sulphite at the temperatures conditions relevant for the usage of the package. For example at a temperature of about 20° C., potassium sulphite has a water solubility of about 51.49 mass % and 6.71 mol/kg in comparison to the water solubility of sodium sulphite which has been shown to be about 20.82 mass % and 2.086 mol/kg at the same temperature. At a temperature of about 0° C. potassium sulphite has been shown to have a water solubility of about 51.3 mass % and 6.66 mol/kg compared to about 12.50 mass % and 1.113 mol/kg of sodium sulphite.

The applicant has discovered that within the application of thin parts, such as weakening features, such as tear-lines, sodium sulphite particles with the following size characteristics provide the best properties against oxygen ingress:

(i) 0% having a size above 75 micrometers, and (ii) an average size below 25 micrometers.

Notably, an advantage with the sulphite particles described above in comparison with for example organic polymeric scavengers is that the sulphite particles do not require a catalyst to be used in order to be implemented in the polymeric opening portion 30. Moreover, organic polymer scavengers need to be incorporated at such amounts that the resulting mouldable polymer composition material becomes too brittle for the use in the described type of opening portions. In addition, such oxygen scavengers often give rise to some kind of undesirable by-effect, due to degradation of the material, such as discolouration or an indesirable smell or odour from the material. Instead, the sodium sulphite particles simply can be added to the polymer composition of the polymeric opening portion, thereby a less complex and less costly manufacturing process can be achieved.

Figure 4:
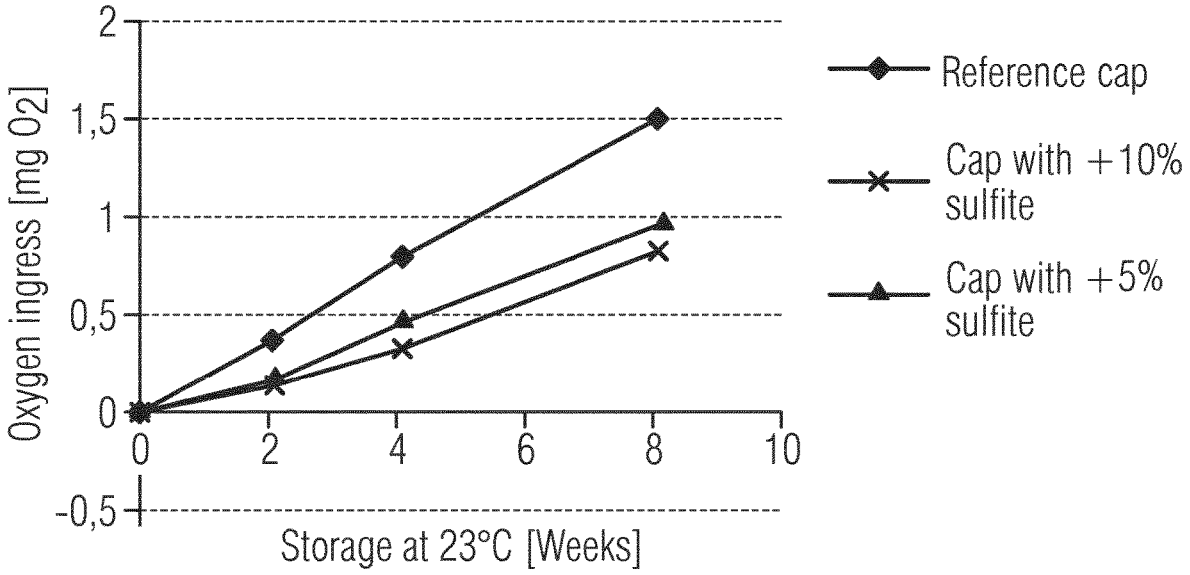
FIG. 4 is a graph depicting the oxygen ingress for polymeric opening devices comprising different material blends at 23° C.
Figure 5:
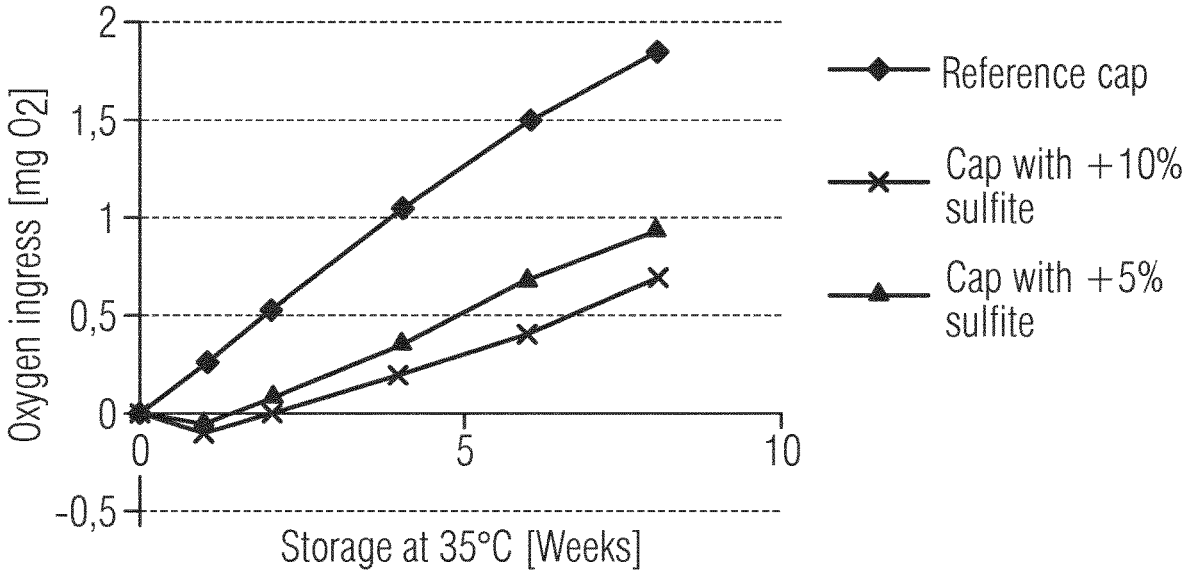
FIG. 5 is a graph depicting the oxygen ingress for polymeric opening devices comprising different material blends at 35° C.

With reference to FIGS. 4 and 5 a comparison between opening portions with tear-lines comprising only a reference polymer, a composition with 10 weight-% sodium sulphite particles in the same polymer and a 5 weight-% sodium sulphite particles in the same polymer, at 23° C. and 35° C. respectively, is shown. As is evident from said comparison the polymeric opening portions comprising sodium sulphite particles provide substantially lesser oxygen ingress in comparison to the reference polymer, especially with regards to a polymer comprising 5 weight-% sodium sulphite.

Based on the aforementioned, the polymer composition forming the opening portion 30 may preferably comprise between 2 to 20 wt % sodium sulphite particles and even more preferably between 5 to 10 wt %.

With further reference to FIGS. 1 to 3 the package 10 may further comprise a package container body 12 in turn comprising an oxygen barrier material, such as aluminium foil, advantageously in combination with other conventional packaging materials such as paperboard and/or polymer. Preferably, the aluminium foil and the combined packaging materials are arranged in a layered structure.

In some instances opening portions are moulded directly to an open-ended package container body, whereby the opening portion may at least partly envelop said container body, forming an interface between said opening portion and the package container body.

The interface is associated with increased oxygen ingress due to the interface not being protected by the oxygen barrier material of the package container body. As previously discussed with regards to tear-lines, it would be advantageous to provide a package for pourable food products which reduces the oxygen ingress through the interface without inducing cracks causing leakages.

Hence, one aspect of present invention refers to a package 10 with a package container body 12 and an opening portion 30 moulded onto said package container body 12. Thereby, an interface between said package container body (12) and opening portion (30) is formed. According to some embodiments said interface can be formed by the opening portion enveloping the container body.

Preferably, the package container body 12 comprises paperboard and foil such as aluminium foil which may be arranged in a layered structure.

To provide a package which reduces the oxygen ingress through said interface without inducing cracks causing leakages, the polymeric opening portion may comprise sodium sulphite, such as for example anhydrous Na2SO3 particles, with the following size characteristics:

(i) 0% having a size above 75 micrometers, and (ii) an average size below 25 micrometers.

Even more preferably, the sulphite particles may have the following size characteristics:

(i) 0% having a size above 50 micrometers, and (ii) an average size below 15 micrometers.

As with the-tear line, the sodium sulphite particles are particularly beneficial in relation to other oxygen-eaters, such as organic polymer oxygen eaters, such as MXD6-polyamide, and to potassium sulphite. Sodium sulphite notably has lower oxygen and water solubility than alternative oxygen-eaters which reduces the risk for agglomeration of the particles during manufacturing, since the agglomeration increases with the water and air solubility. Thereby cracks induced due to particle agglomeration can be avoided.

Consequently, the size characteristics are especially advantageous since it minimises the risk of accumulation of particles during moulding which leads to inducing of cracks during storage and transport of the package.

Figure 6:
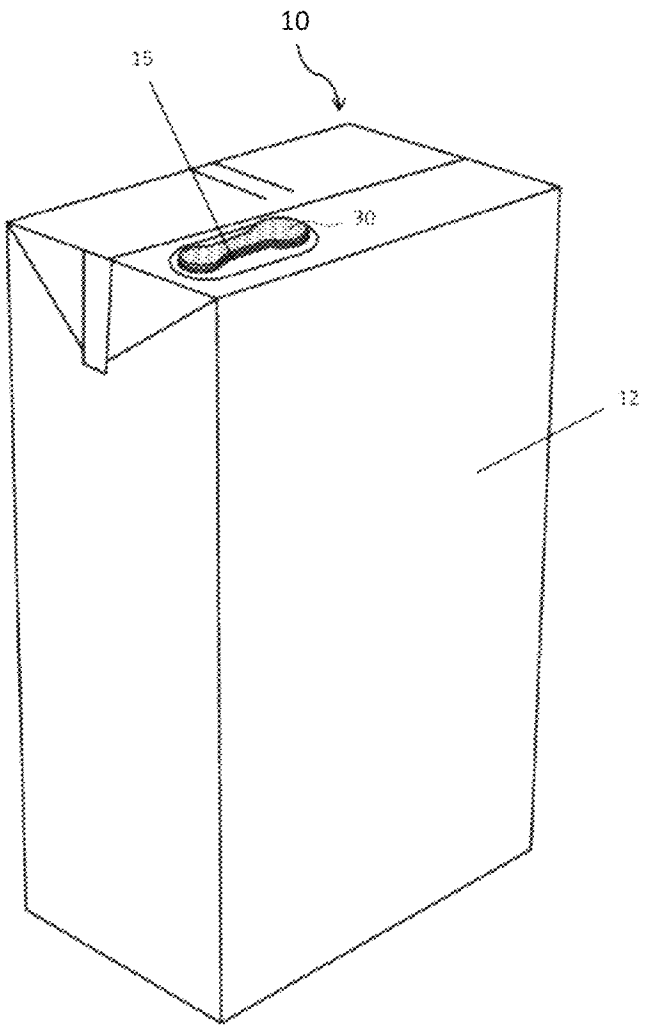
FIG. 6 is a side view of a package for pourable food according to one embodiment.

Referring to FIG. 6 a package 10 is shown. The package comprises a package container body 12 comprising an oxygen barrier material and an opening portion 30 adjacent to said container body 12. Hence, an interface 15 is defined by the border region surrounding the opening portion 30. According to this example, the opening portion 30 may comprise less oxygen barrier material or even no oxygen barrier material at all.

Figure 7:
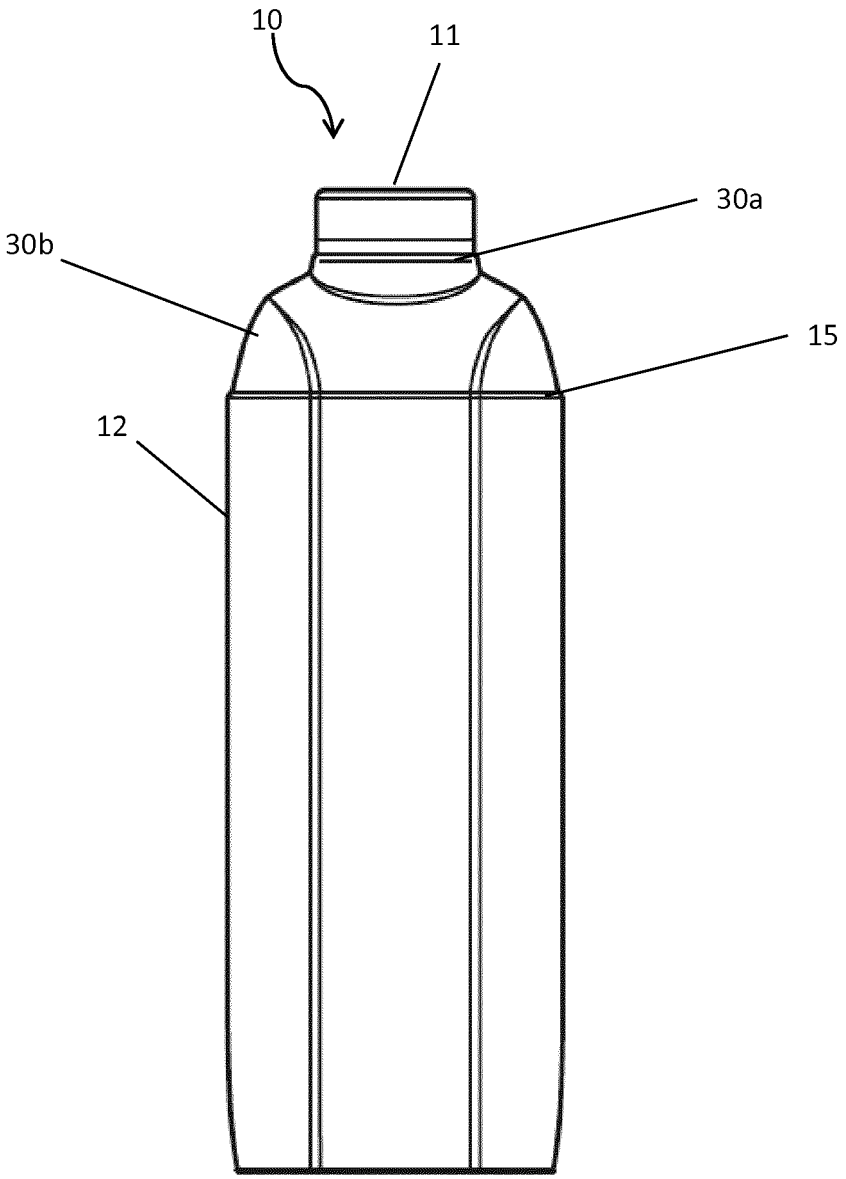
FIG. 7 is a side view of a package for pourable food according to one embodiment.

Another type of interface is shown in FIG. 7, whereby a package 10 comprises a package container body 12 in turn comprising an oxygen barrier material and a package container top portion 30*b*, whereby an opening portion 30 thus may comprise an integrated opening part 30*a* and a top portion 30*b*. Compared to the package container body 12, the package container top portion 30 with the opening part 30*a* does not comprise as much oxygen barrier material or even none at all. To minimise the oxygen ingress both package container top portion 30*b* and the opening part 30*a* may be formed from the previously discussed polymer composition. As evident from said figure the interface 15 may be the relatively large wall portion of the opening portion 30 and top portion 30*b* without oxygen barrier material.

Further, the invention has mainly been described with reference to a few embodiments. However, as is readily understood by a person skilled in the art, other embodiments than the ones disclosed above are equally possible within the scope of the invention, as defined by the appended claims.

The invention claimed is:

1. A package for pourable food products, said package comprising an opening portion comprising a polymer composition, said opening portion further comprising a weakening feature having a thickness below 200 micrometers and being thinner than parts of the opening portion directly adjacent to said weakening feature, wherein the polymer composition comprises sodium sulphite particles, wherein none of said sodium sulphite particles have a size greater than 75 micrometers, and wherein an average size of said sodium sulphite particles is below 25 micrometers.

2. The package for pourable food products according to claim 1, wherein none of said sodium sulphite particles have a size greater than 50 micrometers, and wherein the average size of said sodium sulphite particles is below 15 micrometers.

3. The package for pourable food products according to claim 1, wherein the polymer composition of the opening portion comprises between 2 to 20 wt % sodium sulphite.

4. The package for pourable food products according to claim 3, wherein the polymer composition of the opening portion comprises between 5 to 10 wt % sodium sulphite.

5. The package for pourable food products according to claim 1, wherein the sodium sulphite particles are anhydrous $Na_2SO_3$ particles.

6. The package for pourable food products according to claim 1, wherein the opening portion is moulded.

7. The package for pourable food productions according to claim 6, wherein the opening portion is injection moulded.

8. The package for pourable food products according to claim 1, wherein the polymer composition comprises high density polyethylene (HDPE).

9. The package for pourable food products according to claim 1, wherein the polymer composition comprises low density polyethylene (LDPE).

10. The package for pourable food products according to claim 1, wherein the polymer composition comprises a blend comprising a polymer selected from the group of HDPE, LDPE, and linear low density polyethylene (LLDPE).

11. The package for pourable food products according to claim 1, wherein the package further comprises a package container body, and wherein the opening portion is moulded onto said package container body so as to form an interface between said package container body and said opening portion, the package container body comprising a laminate material, said laminate material comprising a cellulose based layer, a polymer layer, and an oxygen barrier material.

12. A method for providing an opening portion for a package for pourable food products, the method comprising:

adding sodium sulphite particles to a polymer composition to form the opening portion of the package, wherein none of said sodium sulphite particles have a size greater than 75 micrometers, and wherein an average size of said sodium sulphite particles is below 25 micrometers; and forming the opening portion by moulding, said opening portion comprising a weakening feature having a thickness below 200 micrometers and being thinner than parts of the opening portion directly adjacent to said weakening feature.

13. A package for pourable food products, the package comprising a package container body and an opening portion moulded onto said package container body so as to form an interface between said package container body and said opening portion, the package container body comprising an oxygen barrier material, the opening portion comprising a polymer composition comprising sodium sulphite particles, wherein none of said sodium sulphite particles have a size greater than 75 micrometers, and wherein an average size of said sodium sulphite particles is below 25 micrometers.

14. The package for pourable food products according to claim 13, wherein the oxygen barrier material is an aluminium foil.

* * * * *